US006062437A

United States Patent [19]

Mascitelli

[11] Patent Number: 6,062,437

[45] Date of Patent: May 16, 2000

[54] CONTAINER REDUCIBLE IN SIZE DURING USE, WITH DISPENSER SPOUT FITTED WITH CHECK VALVE

[75] Inventor: Francesco Mascitelli, Pescara, Italy

[73] Assignee: SAR S.p.A., San Giovanni Teatino, Italy

[21] Appl. No.: 09/153,158

[22] Filed: Aug. 15, 1998

[30] Foreign Application Priority Data

Sep. 30, 1997 [IT] Italy ..... RM97U0203

[51] Int. Cl.[7] ..... B65D 37/00

[52] U.S. Cl. ..... 222/212; 222/214

[58] Field of Search ..... 222/206, 215, 222/211, 212, 321.1, 321.6, 386.5, 214

[56] References Cited

U.S. PATENT DOCUMENTS

| | | | |
|---|---|---|---|
| 2,738,107 | 3/1956 | Graham | 222/211 |
| 3,390,821 | 7/1968 | Mullan | 222/212 |
| 3,506,163 | 4/1970 | Rauh et al. | 222/212 |
| 4,098,434 | 7/1978 | Uhlig | 222/212 |
| 4,622,085 | 11/1986 | Yamada et al. | 222/213 |
| 5,320,256 | 6/1994 | Wood | 222/212 |

*Primary Examiner*—Gregory L. Huson
*Assistant Examiner*—Keats Quinalty
*Attorney, Agent, or Firm*—Browdy and Neimark

[57] ABSTRACT

The present invention relates to a container reducible in size during use, with dispenser spout fitted with check valve. It comprises a bellows bottle, presenting, at one of its ends, a closed bottom and, at the opposite end, a neck destined to receive a dispenser spout fitted with a check valve with mushroom-shaped shutter. The bellows bottle is positioned inside a container with variable volume, constituted by two hollow cylinders able coaxially to slide one inside the other, the neck passing through the outer cylinder.

4 Claims, 2 Drawing Sheets

CONTAINER REDUCIBLE IN SIZE DURING USE, WITH DISPENSER SPOUT FITTED WITH CHECK VALVE

BACKGROUND OF THE INVENTION

The present invention relates to a container reducible in size during use, with dispenser spout fitted with check valve.

Current packaging systems destined to contain a fluid product in paste or gel form and the like and to dispense it, essentially comprise a container, such as, for instance, a bottle made of glass or plastic, and a dispenser, which may consist of a nebulising or dispensing pump.

In current packaging systems, therefore, the container has the function not only to contain, but also to identify the product by means of printed reproductions, labels or other means applied thereto, whilst the dispensing system has the function of transferring the product from the inside of the container to the outside in quantities more or less accurately metered.

At the end of their useful life, possibly prolonged with repeated fillings with so-called "re-fill" packs, current packaging systems generally retain a volume that is essentially equal to the one they had at the start of their use. The impossibility to reduce the dimensions of the container simply through manual flattening due to their usual rigidity entails problems with bulk in their transportation as solid urban waste to disposal in tips or incinerators or, when possible, as differentiated collection destined to recycling. As is well known, voluminous waste not only creates transportation problems but also increases the cost of the disposal and recycling operations themselves.

SUMMARY OF THE INVENTION

The main aim of the present invention therefore is to eliminate the aforementioned drawbacks, deriving from the stated sharp distinction between the functions of the container and those of the dispenser in a packaging system.

In particular, the important aim of the present invention is to realize a packaging system of the type mentioned which, at the end of its working life, acquires and retains a reduced volume with respect to the initial one, in order to decrease transportation, disposal and recycling costs.

The invention, as it is characterized by the claims that follow, solves the problem of providing a container reducible in size during use, with dispenser spout fitted with check valve, which from a general point of view is characterized in that said container comprises a bellows bottle, presenting, at one of its ends, a relatively undefinable closed bottom and, at the opposite end, a neck destined to receive internally a dispenser spout and fitted externally with means for coupling the neck itself with a ring nut able to secure said dispenser spout to said bellows bottle; a check valve being applied in the inner end of the conduit of said dispenser spout.

Additional features and advantages of the present invention shall become more readily apparent from the detailed description that follows, of a preferred embodiment shown purely by way of non limiting indication in the accompanying drawings.

DESCRIPTION OF THE PREFERRED EMBODIMENT

In accordance with the present invention, in the figures the number 1 indicates a bottle, the number 2 indicates a dispenser spout, 3 a check valve, 4 a fastening ring nut and 5 an outer casing.

Figure 1:
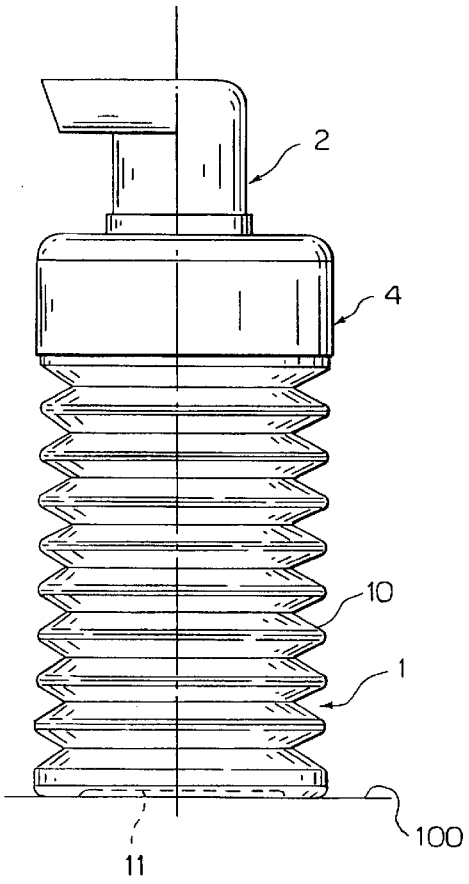
FIG. 1 shows a side view of a container according to the invention in the condition of maximum capacity.
Figure 2:
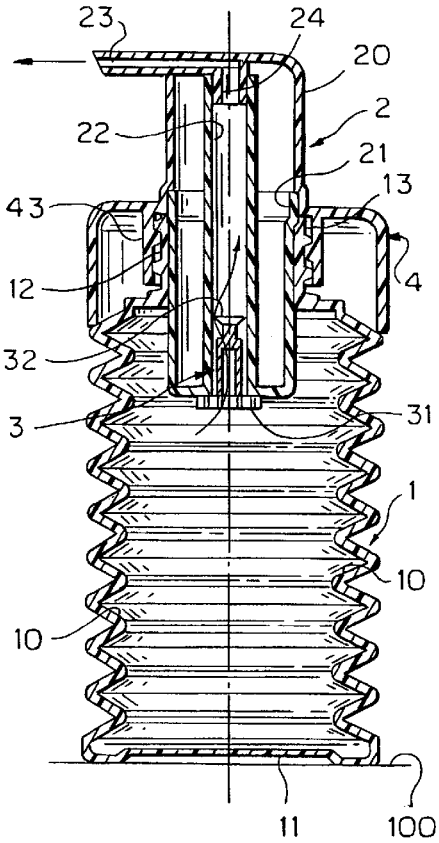
FIG. 2 shows an axial longitudinal section of the container of FIG. 1.

As better shown in FIG. 2, the bottle 1 is preferably a deformable container of cylindrical shape. Its side wall 10 is sufficiently thin and undulated, or pleated, like a bellows. The bellows bottle 1 presents, at one of its ends, a closed bottom 11, slightly more rigid than the wall in order to be relatively undeformable. At the end opposite to the bottom 11, a neck 12 is provided. The neck 12 receives internally the dispenser spout 2 in its essentially cylindrical portion 20.

The cylindrical portion 20 presents a slightly widened portion 21, which fits in contact with the free end of the neck 12 of the bottle.

The cylindrical portion 20 of the dispenser spout 2 presents coaxially in its interior a vertical conduit 22 for the product to be dispensed. The upper end of the vertical conduit 22 is joined, through a union 24, to a horizontal conduit 23 in the upper end of the spout 2. In this way a continuous conduit 22–23 is provided for transferring outwards the product contained inside the bottle 1. Obviously the dispenser spout 2 can be realized in other desired shapes. As FIG. 2 shows, the dispenser spout 2 is retained on the neck 12 of the bottle 1 by means of the fastening ring nut 4. The ring nut is screwed externally to the neck 12 by means of respective thread 13 and counter-thread 43. Naturally, other means for coupling the neck 12 itself to the ring nut 4 can be provided. In the inner end of the vertical conduit 22 is applied the check valve 3. As shown, the check valve 3 presents a hollow cylindrical body 30 laterally holed. The hollow body 30 is provided, in its end facing the interior of the bottle 1, with a stop flange 31 peripherally holed and, in its opposite end, with a flexible mushroom-shaped shutter 32, in unidirectional sealing contact with the vertical conduit 22 of the dispenser spout 2. According to the invention, the bellows bottle 1 not only has the function of containing the product but also serves as a pump for dispensing it in the following manner. Suppose the bottle 1 is set down on a rigid base 100 or on any contrast surface.

If a downward vertical force is manually applied on the dispenser spout 2, the spout 2 will move with all the upper part of the bellows bottle 1. The product container therein reaches a sufficient pressure to travel through the holes of the hollow body 30 of the check valve 3 and to deform inwardly the mushroom shutter 32. The peripheral edge of the shutter 32 becomes detached from the wall of the conduit 22 and the check valve 3 allows the product to advance up the vertical conduit 2 and the horizontal conduit 23 to reach the outside. Clearly, the check valve can be embodied differently from this description.

As mentioned above, during the dispensing action, performed with the downward vertical movement of the dispenser spout 2, the bellows bottle 1 is deformed downward, reducing its inner volume or capacity by a quantity equal to that of the dispensed product.

At the end of the individual dispensing operation, when the downward vertical force is removed, the bellows bottle stops deforming and attempts to return the stored elastic energy, thrusting the dispenser spout 2 upwards. Under the effect of the vacuum that is determined in the vertical and horizontal conduit 22 and 23, the part of product contained in the conduit 22–23 between the valve 3 and the outside is drawn towards the interior of the bottle 1.

The restoration of atmospheric pressure inside the dispenser spout 2 is such as to cause the peripheral edge of the mushroom shaped shutter 32 to bear against the walls of the conduit 22, thereby closing the valve 3. The check valve 3 therefore effects a unidirectional conduction of the product outwards from the interior of the bottle. Thus, air is prevented from entering the bottle, which therefore remains in the contracted position reached in the described dispensing operation.

Advantageously, the content of the bottle during the use of the container according to the invention is not in contact with air, thus allowing to avoid the introduction, when formulating products prone to oxidation such as cosmetics, of oxidation-preventing and preservative substances in general.

Figure 3:
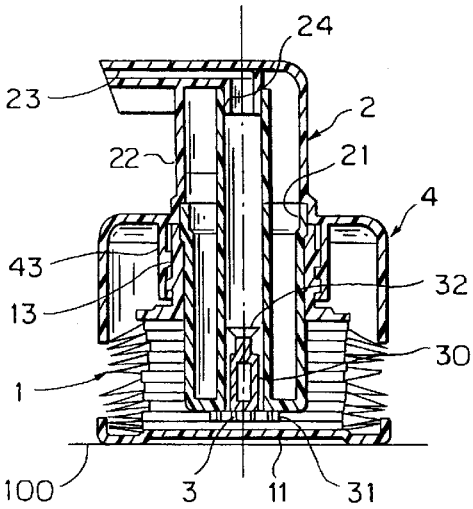
FIG. 3 shows a longitudinal section of the container of FIG. 2 in the condition of minimum capacity.

After repeated dispensing operations, when the product has been fully extracted, the bellows bottle is completely flattened in the condition shown in FIG. 3. The container can be sent to its disposal or recycling, so permanently compacted thanks to the check valve 3 which prevents air from entering the empty bellows bottle 1.

Figure 4:
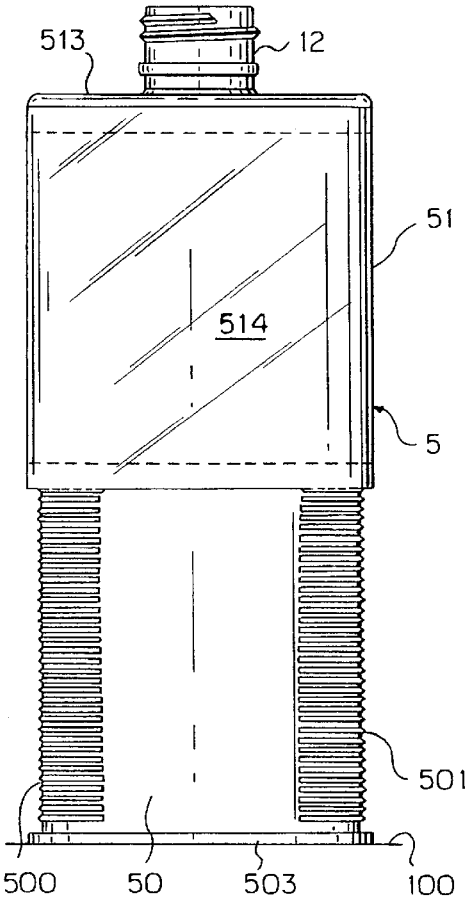
FIG. 4 shows a side view of a casing for the container according to the invention in the condition of maximum capacity, without dispenser spout.
Figure 5:
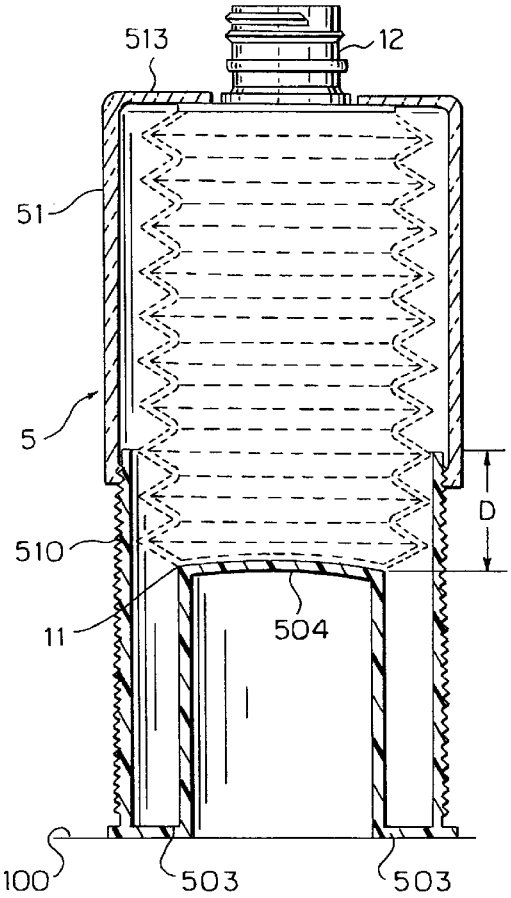
FIG. 5 shows an axial longitudinal section of the casing of FIG. 4.
Figure 6:
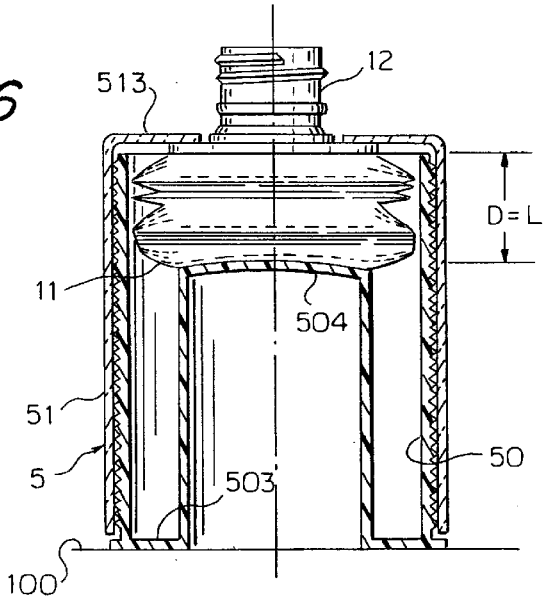
FIG. 6 shows a longitudinal section of the casing of FIG. 4 in the condition of minimum capacity of the container according to the invention.

With reference to FIGS. 4 through 6, an accessory is shown for the container according to the invention, in the form of the casing 5, wherein the bellows bottle 1 is placed. The casing 5 has variable volume. It is constituted by two hollow cylinders, inner and outer, 50 and 51, able coaxially to slide one inside the other. The outer diameter of the inner cylinder 50 is smaller than the inner diameter of the outer cylinder. The inner cylinder 50 is able to slide within the outer cylinder 51, since the two cylinders lack their mutually opposite bases. The cylinder 50 is made to slide within the outer cylinder 51 by means of the mutual engagement of their lateral walls. In particular, this engagement is obtained with opposite indentations 500, 501 with partially circumferential development formed on the outer lateral surface of the cylinder 50. The teeth of the indentations 500, 501 are destined to engage with at least one circumferential projection 510 provided in the free end of the outer cylinder 51.

Between the opposite bases 503 and 513 of the cylinders 50 and 51 the bellows bottle 1 is retained inside the cylinders. The neck 12 of the bellows bottle 1 passes through an opening obtained in the base 513 of the outer cylinder 51. Advantageously, the base 503 of the inner cylinder 50 is recessed therein in a recessed base 504 to an extent such that the distance D between the free end of the inner cylinder 50 and the recessed base 504 is equal to the length L of said bellows bottle 1, when completely flattened, as shown in FIG. 6.

In particular the recessed base 504 is shaped correspondingly to the bottom 11 of the bottle 1.

The casing 5 of the container according to the invention is particularly useful because it allows a gradual flattening of the bellows bottle regulated by the passage of the teeth of the indentations 500, 501 of the inner cylinder 50 on the projection 510 of the outer cylinder 51. In this way, the user can always cause a metered quantity of product, or a multiple quantity thereof, to be released, depending on whether the projection 510 is made to be overtaken by a single tooth or by multiple teeth for each dispensing operation.

Moreover, the casing 5 provides the container according to the invention with an ample surface, the outer surface 514 of the outer cylinder 51 whereon printed reproductions, labels or other means for identifying the product contained within the bellows bottle can be applied.

The invention thus conceived may be subject to numerous modifications and variations, without thereby departing from the scope of the innovative concept. Moreover, all components may be replaced with technically equivalent elements.

In practice, modifications and/or improvements are obviously possible, without thereby departing from the scope of the claims that follow.

What is claimed:

1. Container reducible in size during use, with dispenser spout fitted with check valve, said container comprising a bellows bottle, presenting, at one of its ends, a closed bottom relatively undeformable and, at the opposite end, a neck destined to receive internally a dispenser spout and provided externally with means for coupling the neck itself with a ring nut able to secure said dispensing spout to said bellows bottle; a check valve being applied in the inner end of the conduit of said dispenser spout, wherein said check valve presents a hollow cylindrical body laterally holed, provided, in its end oriented towards the interior of the bottle, with a stop flange peripherally holed and, in it is opposite end, with a flexible mushroom-shaped shutter, in unidirectional sealing contact with said conduit of the dispenser spout.

2. Container according to claim 1, wherein said coupling means are screws, comprising a thread in said neck and a counter-thread in said ring nut.

3. Container reducible in size during use, with dispenser spout fitted with check valve, said container comprising a bellows bottle, presenting, at one of its ends, a closed bottom relatively undeformable and, at the opposite end, a neck destined to receive internally a dispenser spout and provided externally with means for coupling the neck itself with a ring nut able to secure said dispensing spout to said bellows bottle; a check valve being applied in the inner end of the conduit of said dispenser spout wherein said bellows bottle is positioned inside a casing with variable volume, constituted by two hollow cylinders, the inner one having smaller diameter than the outer one, able to slide coaxially one inside the other by means of the mutual engagement of their lateral walls; the two cylinders, lacking the bases that would be facing each other, retaining, in contact with their opposite bases the bellows bottle, protruding with its neck through an opening obtained in said base of outer cylinder, wherein said inner cylinder presents on its outer lateral surface opposite indentations with partially circumferential development, whose teeth are destined to engage with at least one circumferential projection provided in the free end of said outer cylinder.

4. Container reducible in size during use, with dispenser spout fitted with check valve, said container comprising a bellows bottle, presenting, at one of its ends, a closed bottom relatively undeformable and, at the opposite end, a neck destined to receive internally a dispenser spout and provided externally with means for coupling the neck itself with a ring nut able to secure said dispensing spout to said bellows bottle; a check valve being applied in the inner end of the conduit of said dispenser spout wherein said bellows bottle is positioned inside a casing with variable volume, constituted by two hollow cylinders, the inner one having smaller diameter than the outer one, able to slide coaxially one inside the other by means of the mutual engagement of their lateral walls; the two cylinders, lacking the bases that would be facing each other, retaining, in contact with their opposite bases the bellows bottle, protruding with its neck through an opening obtained in said base of outer cylinder, wherein said outer cylinder has its own base recessed internally therein in a recessed base to such an extent that the distance (D) between the free end of the inner cylinder and said recessed base is equal to the length (L) of said bellows bottle, when fully flattened.

* * * * *